US006862859B2

(12) United States Patent
Kronenberg

(10) Patent No.: US 6,862,859 B2
(45) Date of Patent: Mar. 8, 2005

(54) PLUG CONNECTOR FOR HOLLOW SECTIONS

(76) Inventor: Max Kronenberg, Bünkenberg 2, 42657 Solingen (DE)

( * ) Notice: Subject to any disclaimer, the term of this patent is extended or adjusted under 35 U.S.C. 154(b) by 4 days.

(21) Appl. No.: 10/311,834

(22) PCT Filed: Sep. 12, 2001

(86) PCT No.: PCT/EP01/10505

§ 371 (c)(1),
(2), (4) Date: Dec. 16, 2002

(87) PCT Pub. No.: WO02/23004

PCT Pub. Date: Mar. 21, 2002

(65) Prior Publication Data

US 2004/0088943 A1 May 13, 2004

(30) Foreign Application Priority Data

Sep. 13, 2000 (DE) ..... 200 15 913 U

(51) Int. Cl.[7] ..... E06B 3/68; E06B 3/66

(52) U.S. Cl. ..... 52/656.9; 52/656.5; 52/656.6; 403/298; 403/295

(58) Field of Search ..... 52/656.9, 656.6, 52/656.5, 656.2; 403/231, 295, 298, 402, 403

(56) References Cited

U.S. PATENT DOCUMENTS

| | | | | | |
|---|---|---|---|---|---|
| 3,467,423 | A | * | 9/1969 | Schlegel, Jr. et al. | 403/270 |
| 3,613,279 | A | * | 10/1971 | Belfor | 40/782 |
| 3,643,989 | A | * | 2/1972 | Sattler | 403/295 |
| 4,105,348 | A | * | 8/1978 | Anderson et al. | 403/172 |
| 4,296,587 | A | * | 10/1981 | Berdan | 52/786.1 |
| 4,862,612 | A | * | 9/1989 | Sugihara et al. | 40/782 |
| 5,209,599 | A | * | 5/1993 | Kronenberg | 403/298 |
| 5,560,731 | A | * | 10/1996 | Kronenberg | 403/298 |
| 6,244,012 | B1 | * | 6/2001 | McGlinchy et al. | 52/665 |
| 6,301,843 | B1 | * | 10/2001 | Silverman | 52/204.5 |
| 6,347,902 | B1 | * | 2/2002 | Loh | 403/298 |
| 6,406,213 | B1 | * | 6/2002 | Dohman et al. | 403/298 |
| 6,431,784 | B1 | * | 8/2002 | Kronenberg | 403/297 |

FOREIGN PATENT DOCUMENTS

| | | | | |
|---|---|---|---|---|
| DE | 3201833 A | * | 7/1983 | E06B/3/05 |
| DE | 34 08 600 | | 9/1985 | |
| DE | G 92 16 955.4 | | 5/1994 | |
| DE | G 94 11 067.0 | | 10/1994 | |
| DE | 295 11 885 | | 12/1996 | |
| EP | 0 283 689 | | 9/1988 | |
| WO | WO 98/05843 | | 2/1998 | |
| WO | WO/99/13192 | | 3/1999 | |
| WO | WO 99/34083 | | 7/1999 | |

* cited by examiner

*Primary Examiner*—Brian E. Glessner
(74) *Attorney, Agent, or Firm*—McGlew and Tuttle, P.C.

(57) ABSTRACT

A plug-in connector for hollow sections (24), especially for spacer frames or bar sections of insulating glass panes. The plug-in connector has a middle wall (5) and two side walls (6) joining same with a plurality of lateral retaining elements (12, 13, 14) arranged one after the other in the direction of plugging-in (9) of the hollow sections. At least some of the retaining elements (12, 13, 14) are arranged at the side walls (6) offset transversely to the direction of plugging-in (9) with a said mutual distance (16, 17). The retaining elements may be arranged at various levels to engage at various points on the hollow section.

21 Claims, 9 Drawing Sheets

PLUG CONNECTOR FOR HOLLOW SECTIONS

FIELD OF THE INVENTION

The present invention pertains to a plug-in connector for hollow sections, especially for spacer frames or bar sections of insulating glass panes, with a middle wall and two side walls joining same with a plurality of lateral retaining elements arranged one after the other in the direction of plugging-in of the hollow sections.

BACKGROUND OF THE INVENTION

Such a plug-in connector has been known from EP-A 0 283 689. It is designed for hollow sections of spacer frames of insulating glass panes and has at its two side walls a plurality of retaining elements, which are arranged one after another in the direction in which the hollow sections are plugged in.

SUMMARY OF THE INVENTION

The object of the present invention is to show a plug-in connector with improved retaining elements.

According to the invention, a plug-in connector is provided for hollow sections, especially for spacer frames or bar sections of insulating glass panes, with a plurality of lateral retaining elements arranged one after another at the side wall in the direction of plugging-in of the hollow sections. At least some of the retaining elements are arranged offset at right angles to the direction of plugging-in with a mutual distance.

The offset arrangement of and the mutual distance between the retaining elements at right angles to the direction of plugging-in have the advantage that the retaining elements can act at different positions on the adjacent side wall. This improves the retention of the plug-in connector in the hollow section, because the different retaining elements exert their retaining function in a greater number and more uniformly.

All retaining elements are arranged in one row one after another in the direction of plugging-in, in the state of the art, as a result of which they have different retaining capacities due to tolerances. This is especially true if the retaining elements dig into the side wall of the hollow section during plugging in and form a track or groove-shaped depression in the side wall during the plugging-in operation. Mainly the retaining element that is arranged laterally the farthest and that also determines the depth dug-in acts in this common track. The other retaining elements, which are arranged less far out, may possibly have less or no contact with this track and a correspondingly reduced retaining function. This problem is eliminated with the offset arrangement of and the mutual distance between the retaining elements at right angles to the direction of plugging-in.

The offset arrangement may be present for all retaining elements or for only some of the retaining elements. It is present above all at the side walls of the body sections, because these retaining elements act together on a side wall of a hollow section. The retaining elements at the other side walls or body sections act on other hollow section walls.

The offset arrangement of the retaining elements is preferably designed as a vertical offset. This is especially advantageous for the usual plug-in connectors with an essentially rectangular cross-sectional contour. Furthermore, the design according to the present invention also offers advantages for the connection of bar sections and the desiccant flow at the connection point. The improved seating and hold of the plug-in connector have a favorable effect in the hollow sections for this.

The vertical offset preferably is constant and of uniform size. The retaining element with the greatest height may be optionally located in the area of the middle or the outer front side of the plug-in connector. The retaining elements following it are then arranged lower in a continuous series. At least the retaining element with the greatest height may also project on the edge side in height over the side wall of the plug-in connector and ensure an additional bracing of the plug-in connector in the hollow section or the bar section.

The plug-in connector may otherwise have various designs as desired. It may be a straight connector or a corner connector or the like for spacer frames of insulating glass panes. Furthermore, the plug-in connector may be a straight connector or a cross connector for bar sections. These are preferred fields of use. In addition, the plug-in connectors may also be used for any other purpose and other hollow sections. The plug-in connectors may also have any desired cross-sectional shape and be designed as components that are hollow or solid in at least some areas.

Special advantages arise for plug-in connectors that are designed as punched and bent parts made of metal. The offset retaining elements can be manufactured especially well and effectively in this case. Otherwise, the plug-in connectors may also consist of other materials, e.g., plastic, composite or the like.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
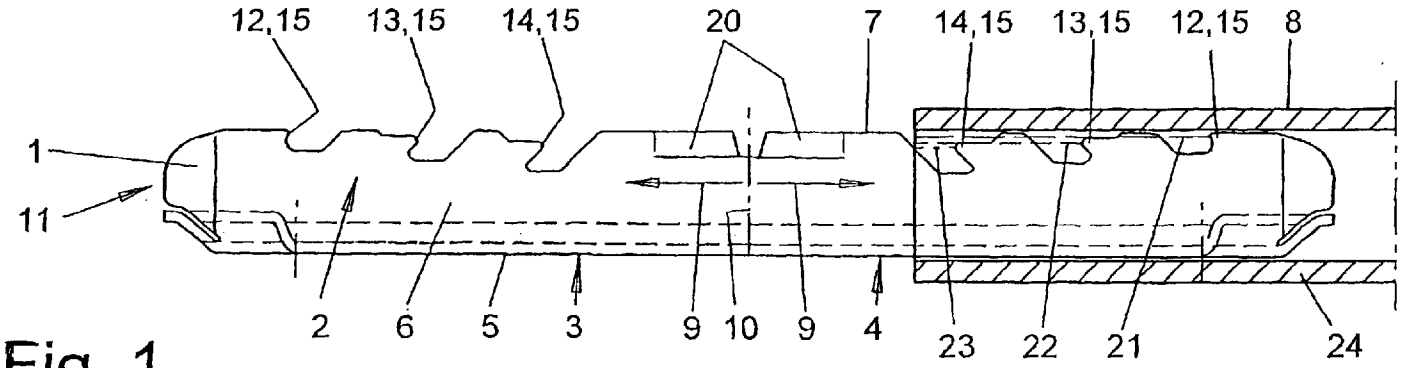
FIG. 1 is a side view of a straight plug-in connector with a cut-away view of a hollow section.
Figure 2:
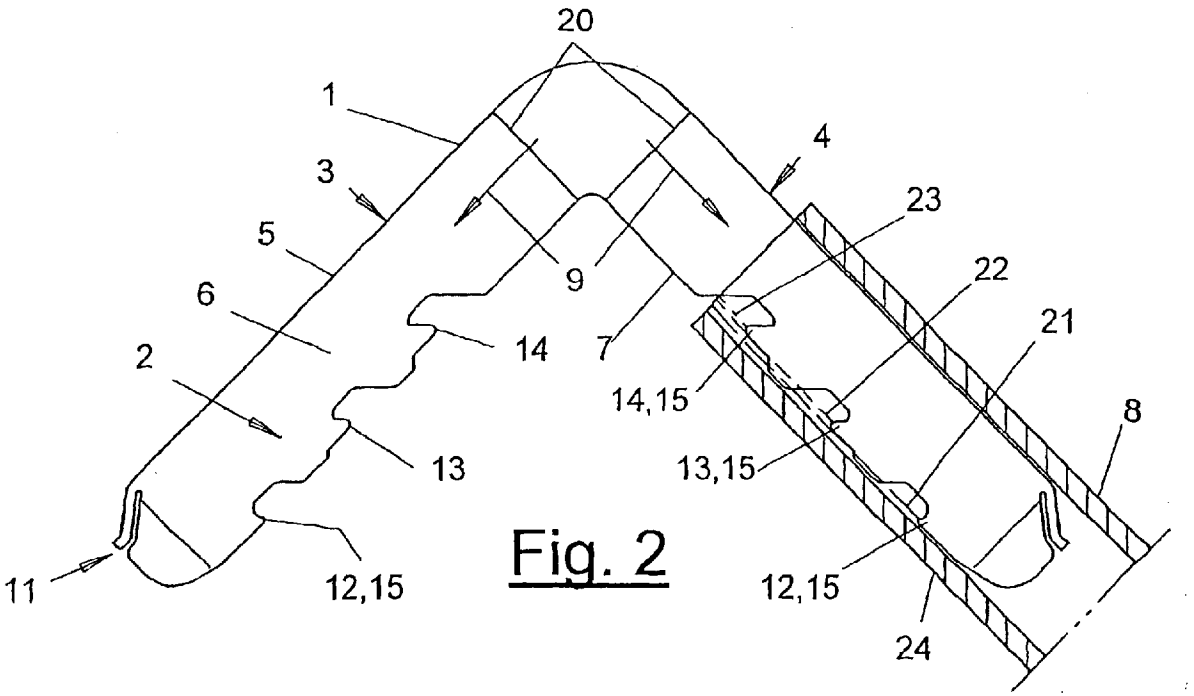
FIG. 2 is a variant of the plug-in connector in FIG. 1 in the form of a corner angle.
Figure 4:
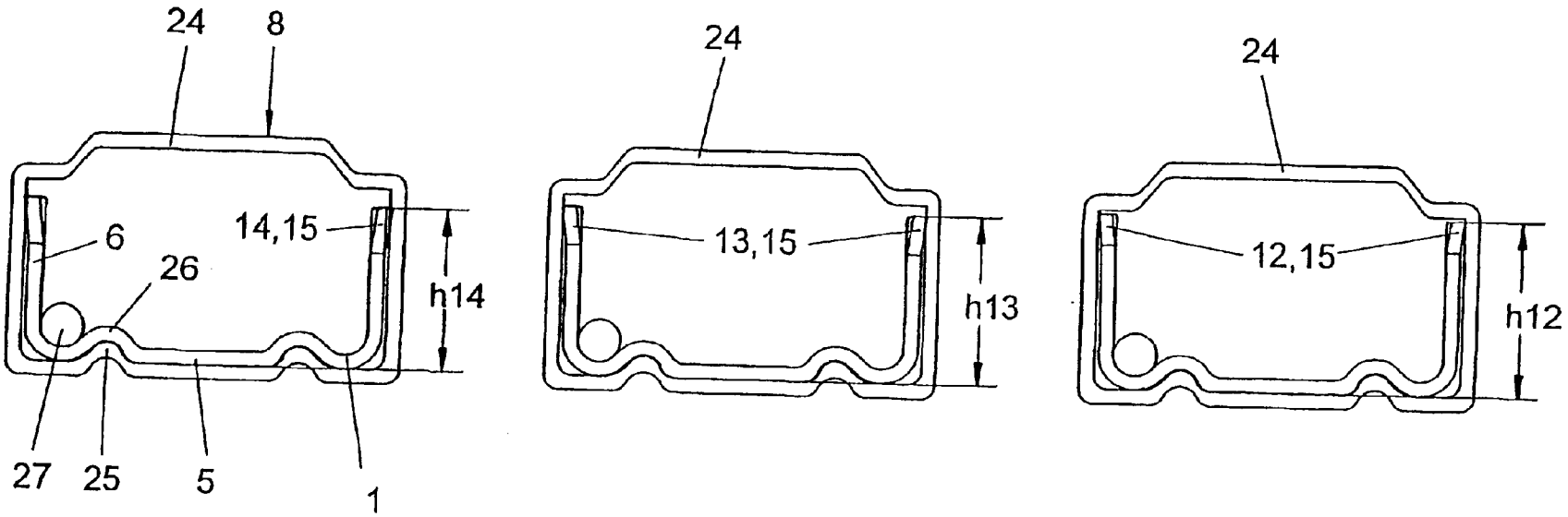
FIG. 4 is a sectional view of the plug-in connector in the hollow section with retaining elements of different heights.
Figure 7:
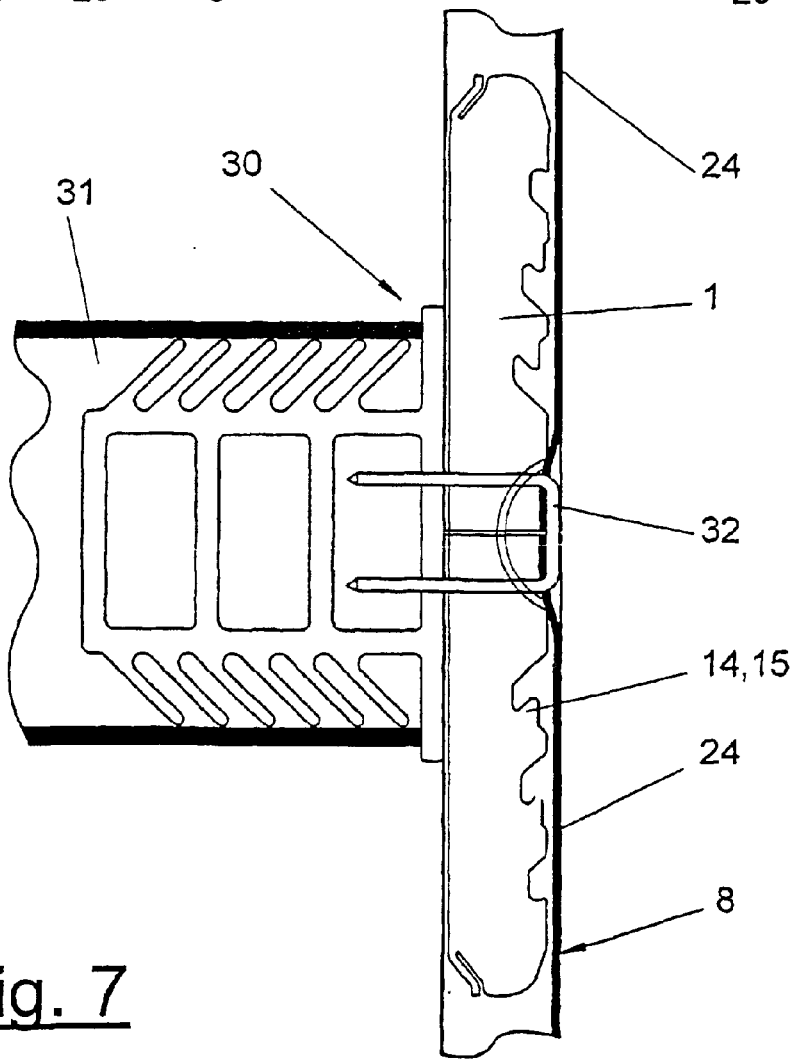
FIG. 7 is a side view of the plug-in connector in the hollow sections at a bar connection.
Figure 10:
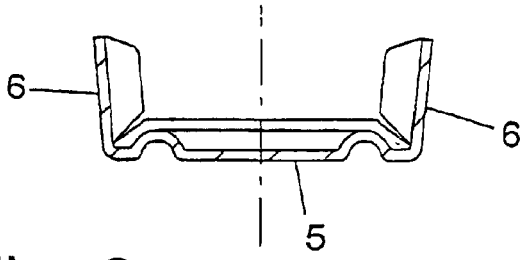
FIG. 10 is an end view of a variant of the plug-in connector with other retaining elements and an elastic middle stop.
Figure 8:
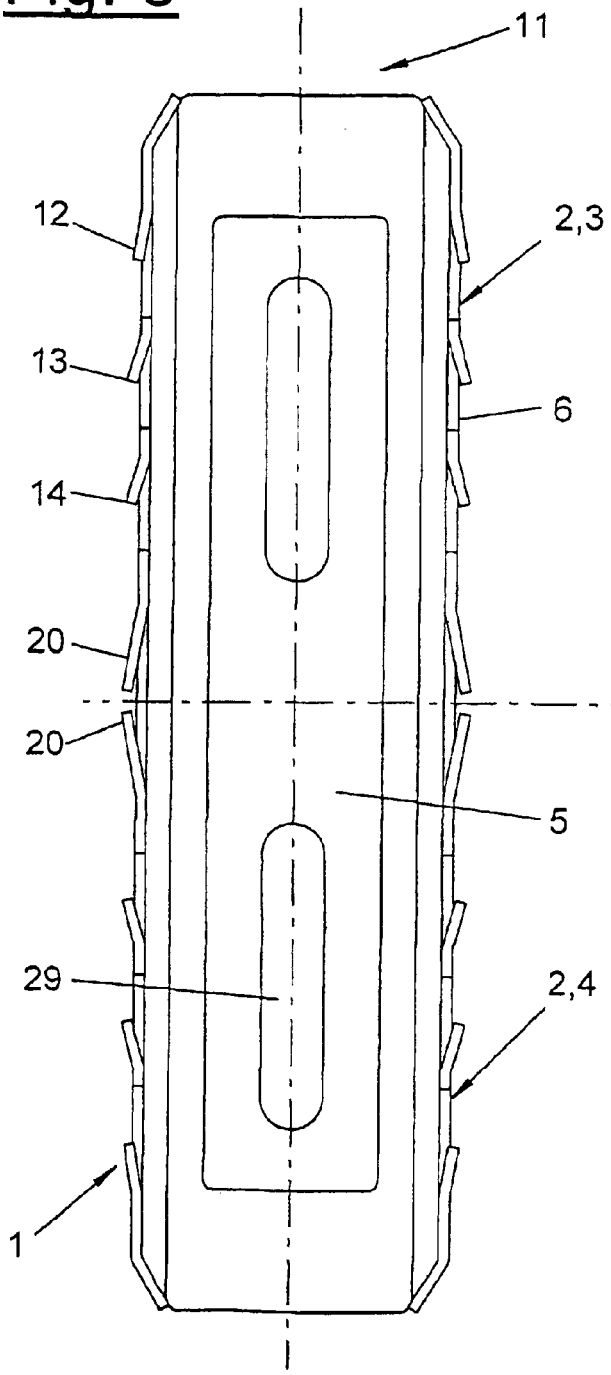
FIG. 8 is a top view of a variant of the plug-in connector with other retaining elements and an elastic middle stop.
Figure 9:
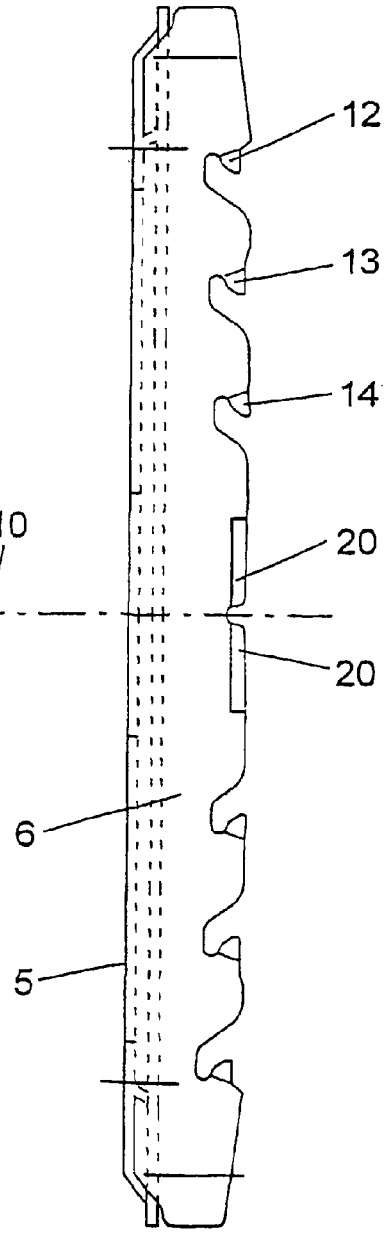
FIG. 9 is a side view of the variant of the plug-in connector with other retaining elements and an elastic middle stop.

Referring to the drawings in particular, The drawings show a plug-in connector 1 for hollow sections 24. The hollow sections 24 may have any desired suitable cross section and in the preferred embodiment they are designed as hollow sections of spacer frames or as bar sections, both of which are used for insulating glass panes. A granulated desiccant 27 may be located in the hollow sections 24, as is indicated in FIG. 4. The hollow sections 24 may otherwise also have any other desired shape and another intended use. FIGS. 1, 2 and 7 show side views of one or two hollow sections 24 each. FIG. 4 shows the cross section of the hollow section 24.

In FIGS. 1 and 5 through 14, the plug-in connector 1 is designed as a straight connector for hollow sections 24 of spacer frames or for bar sections. FIG. 2 shows a modification as a corner angle for the same spacer hollow sections. In one variant, not shown, the plug-in connector 1 may also be designed as a cross connector for bar sections.

In the embodiments shown, the plug-in connector 1 has a body 2 with a usually essentially rectangular cross section adapted to the cross section of the hollow section. The plug-in connector 1 may be designed as an at least partially hollow component with a U-shaped or box-shaped cross section. It has, in particular, widely opening front sides 11 and permits the flow of the desiccant 27. As an alternative, the plug-in connector 1 may also be extensively or completely solid. The front sides 11 may be open or closed.

In the straight connector according to FIGS. 1, 5, 8 and 11, the two sections 3, 4 are flush with one another. These plug-in connectors 1 are centrally symmetrical relative to the middle 10. In the corner angle according to FIG. 2, the body sections 3, 4 are arranged at any desired suitable angle, preferably at right angles, in relation to one another.

In the case of the preferred rectangular cross-sectional shape, the plug-in connector 1 has a middle wall 5 and two side walls 6 bent at the edges of the said middle wall. The plug-in connector 1 has a U-shaped cross section in this design. In the case of a box-shaped cross section, it has a second middle wall. In the preferred embodiment as a straight plug-in connector 1 for spacer hollow sections, the plug-in connector 1 is mounted in the hollow sections 24 such that the middle wall 5 points toward the inner side of the spacer frame, while the free edges 7 of the side walls 6 are directed toward the outer side 8. This arrangement corresponds to that of the plug-in connector in EP-A 0 283 689. However, the positioning may also be reversed.

In the case of the corner angle 1 according to FIG. 2, the middle wall 5 points toward the outer side 8. The arrangement may be reversed in this case as well.

The plug-in connector 1 is always plugged into the hollow sections 24 in the direction of plugging-in 9. The sliding path is limited here by middle stops 20 at the middle 10 of the plug-in connector 1.

In the case of the straight connector according to FIGS. 1 and 8 through 10, the middle stops 20 are designed as spring bosses directed against each other, which are arranged at the edges 7 of the side walls 6 and are bent out on the side. This arrangement corresponds to EP-A 0 283 689.

Figure 5:
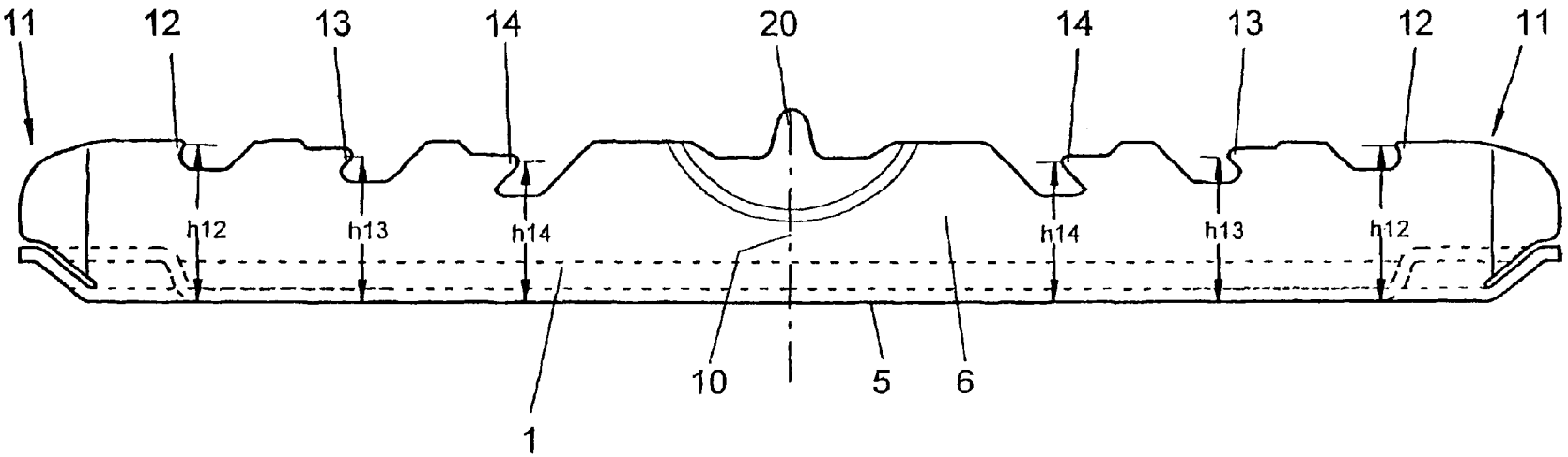
FIG. 5 is a side view of a variant of the plug-in connector in FIG. 1.
Figure 6:
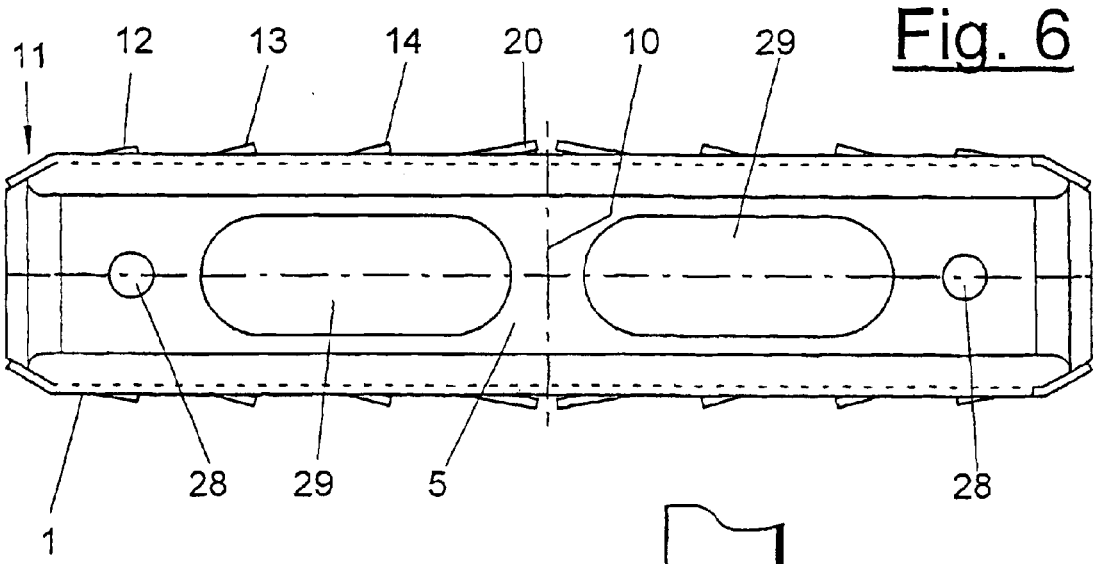
FIG. 6 is a top view of the straight plug-in connector with additional openings on the middle wall.
Figure 11:
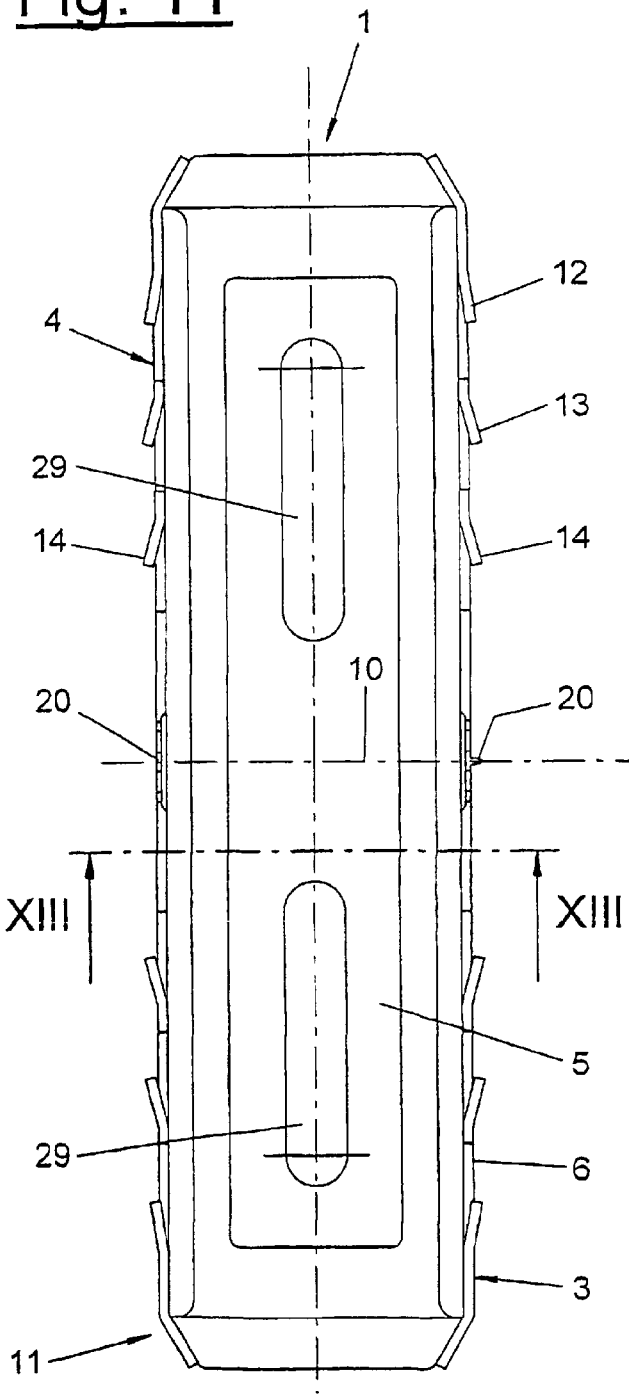
FIG. 11 is a top view of another variant of the plug-in connector with other retaining elements and a fixed middle stop.
Figure 12:
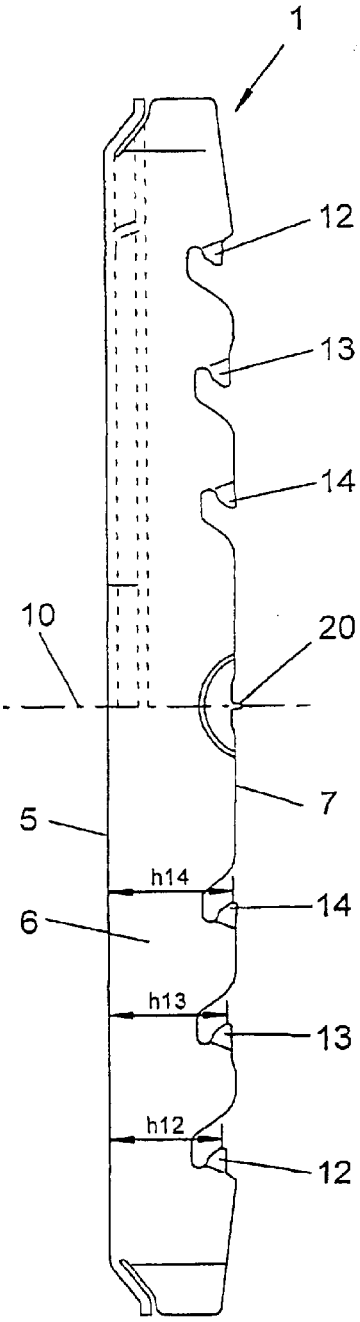
FIG. 12 is a side view of another variant of the plug-in connector with other retaining elements and a fixed middle stop.
Figure 13:
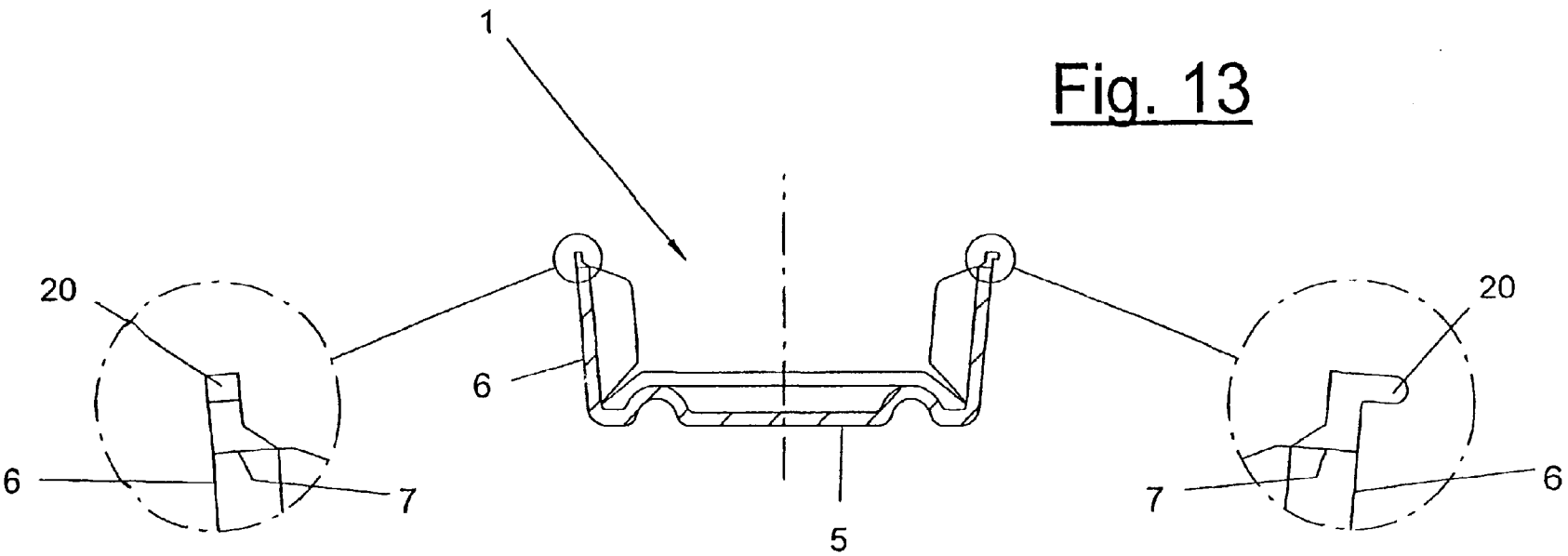
FIG. 13 is a sectional view of another variant of the plug-in connector with other retaining elements and a fixed middle stop as shown in the central part of the figure, with the left side expanded view of the figure showing an enlarged detail of an edge of the plug-in connector with a straight middle stop, and the right side expanded view of the figure showing an enlarged detail of an edge of the plug-in connector with a bent middle stop.

In the case of the straight connector according to FIGS. 5 and 11, the middle stops 20 are designed as central fixed stops corresponding to DE-U 94 11 067 or to WO 98/05843. FIGS. 11 through 12 show two different embodiments for this. In one variant, which is shown in the left-hand part of FIGS. 11 and 13 as well as in the tilted side view in FIG. 12, the middle stop projects beyond the free edge 7 of the side wall 6 in the extension of the said side wall 6. In the variant shown in the right-hand halves of FIGS. 11 and 13, the middle stop 20 is bent laterally to the outside and projects laterally beyond the side wall 6.

In the case of the corner angle according to FIG. 2, the middle stops 20 are located at the corner area and the rigid wall part laterally projecting there. The middle stops 20 may otherwise also have any other desired and suitable design and may optionally also be eliminated.

The plug-in connector 1 is equipped with a plurality of retaining elements 12, 13, 14, which are to prevent the plug-in connector 1 from being pulled out of the hollow sections 24. The retaining elements 12, 13, 14 may have any desired and suitable design for this. They are preferably located at the side walls 6 and project laterally to the outside. They optionally also project upward or downward. The retaining elements 12, 13, 14 cooperate with the preferably smooth inner sides of the side walls of the hollow sections 24 and come into frictional contact with these or optionally also form a positive-locking connection.

In the preferred embodiment, the retaining elements 12, 13, 14 are designed as laterally projecting retaining bosses 15, which are in contact at their tips with the side walls of the hollow sections 24 and preferably also dig into these side walls during the plugging-in operation.

Figure 3:
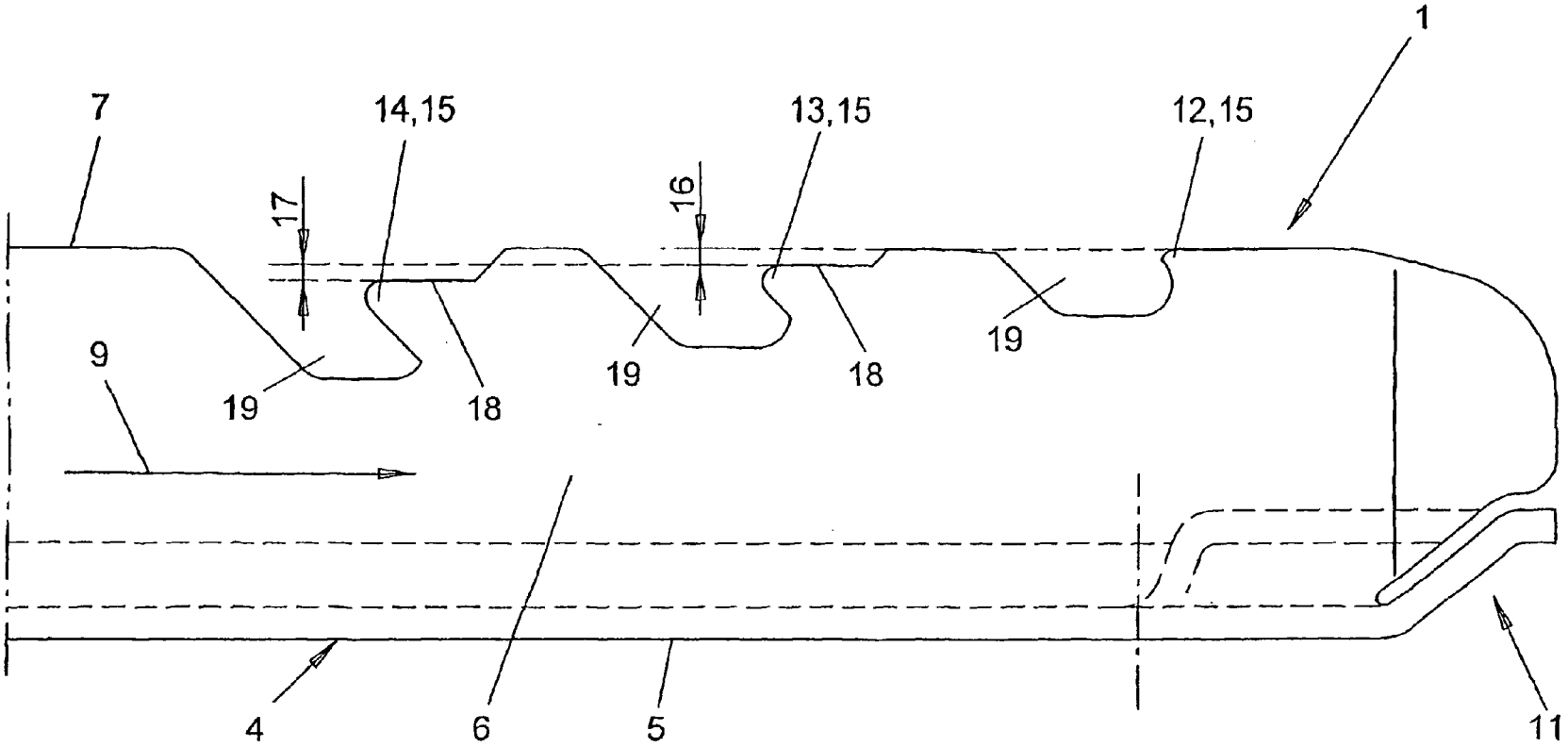
FIG. 3 is an enlarged side view of the retaining elements at a plug-in connector.
Figure 14:
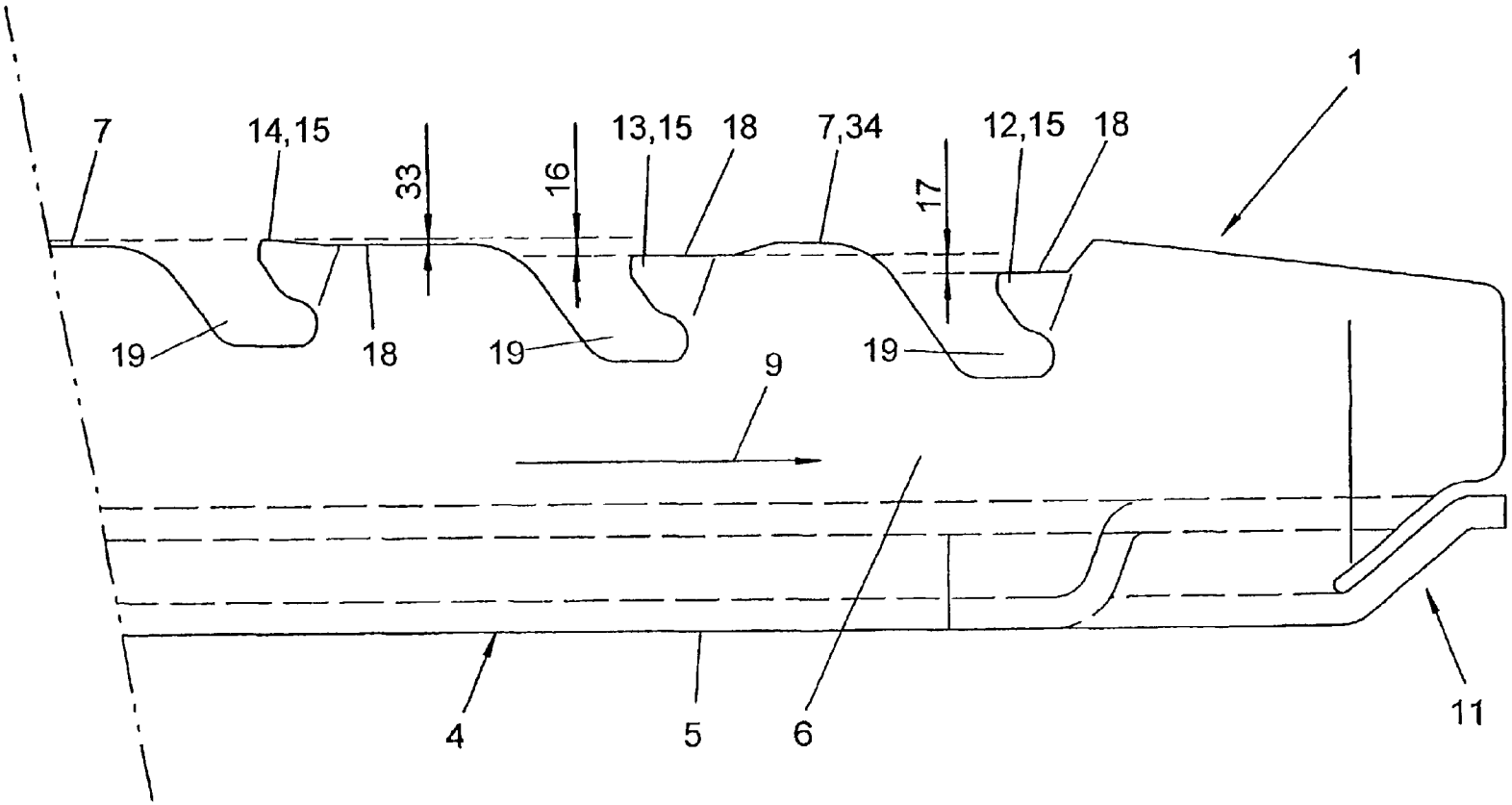
FIG. 14 is a larger partial side view of the plug-in connector.

At least some of the retaining elements 12, 13, 14 of the plug-in connector 1 are arranged offset at right angles to the direction of plugging-in 9 with a mutual distance 16, 17. FIGS. 3 and 14 show this arrangement in an enlarged side view. In the case of the preferred, essentially rectangular cross-sectional shape of the plug-in connector 1, the retaining elements 12, 13, 14 assume different vertical positions h12, h13, h14 at the side walls 6. The retaining elements 12, 13, 14 arranged with an offset now act at different points on the hollow section 24. During plugging in, the retaining bosses 15 dig the tracks 21, 22, 23, which are arranged at different heights and are shown in FIGS. 1 and 2, into the side wall of the hollow section.

In the embodiments shown, the mutual offset or distance 16, 17 is present above all between the retaining elements 12, 13, 14 of every individual side wall 6 of the sections 3, 4. All retaining elements 12, 13, 14 are preferably located at a distance 16, 17 from each other, so that they all act at different points on the adjacent side wall of the particular hollow section 24.

The different side walls or side wall sections 6 may have the same arrangement of the retaining elements 12, 13, 14, because these act on different side walls of different hollow sections 24. In a variant of the embodiment shown, all retaining elements 12, 13, 14 of the plug-in connector 1 may have an offset arrangement.

In another variant, not shown, it is also possible for the distances at the different side walls to be present only partially between the retaining elements located there, and some of the retaining elements may also be arranged at the same height one after another and engage the same axial track on the corresponding hollow section side wall.

In the preferred embodiment, the plug-in connector 1 shown is manufactured as a punched and bent part from metal. It preferably consists of electrolytically galvanized or blank cold rolled steel strip. The retaining elements 12, 13, 14 are designed as punched-out and laterally bent-out retaining bosses 15, which are relatively rigid and elastically yield to lateral forces to a low extent only. Three retaining elements 12, 13, 14 each are arranged at the four different side wall sections 6 in the preferred embodiment. FIGS. 1 through 7, and 8 through 14 show two different embodiments for the arrangement of the retaining elements 12, 13, 14.

As is illustrated in FIGS. 3 and 5, the retaining element 12 located closest to the front side 11 is located at the free edge 7 of the side wall 6 in one variant. It has a distance from the middle wall 5 or a height h12. This is joined, against the direction of plugging-in 9, by a cut-out 19, which will then again rise to the normal height of the edge 7. The adjoining middle retaining element 13 is arranged lower by the distance 16 and has the smaller height h13. The edge 7 first passes over for this into a lowered axial shoulder 18, at the end of which the retaining element 13 is located. A cut-out 19 joins here as well, which will then preferably again rise to the normal edge height. The third retaining element 14, which is adjacent to the middle 10, is again arranged lower than the middle retaining element 13 by a distance 17 with the height h14. The shoulder 18 belonging to it is correspondingly set back farther from the edge 7 toward the middle wall 5. A cut-out 19 again joins here with an adjoining rise up to the normal edge height.

In the variant according to FIGS. 8 through 14, the arrangement and the vertical offset of the retaining elements 12, 13, 14 are reversed compared with the above-described arrangement. As is illustrated especially in FIGS. 12 and 14, the retaining element 14 located closest to the middle 10 has the greatest height h14. The retaining element 13 following it in the direction of plugging-in 9 is arranged lower by the distance 16 and has the smaller height h13. The third retaining element 12 is again arranged lower than the preceding retaining element 13 by the distance 17 and has the smallest height h12.

In the variant according to FIGS. 8 through 14, the cut-outs 19 are larger than in the first exemplary embodiment. They are L-shaped and extend behind the retaining elements 12, 13, 14 to a greater extent, and the undercut has a somewhat increasing rounding at the end. In addition, the retaining element 14, which has the greatest height h14, projects somewhat beyond the edge 7 of the side wall 6 in the embodiment according to FIGS. 8 through 14. The tip of its boss 15 extends beyond the edge 7 in the direction of extension of the side wall 6. The retaining element 14 is also bent obliquely upward toward the edge 7. FIG. 14 shows this arrangement.

The retaining elements 12, 13 likewise have an axial shoulder 18 in this variant, and this shoulder is lowered in relation to the edge 7. While rising to the height of the edge 7, the shoulder 18 of the middle retaining element 13 may pass over into a rounding 34, which makes possible the improved sliding up and support in the hollow sections 24. The shoulder 18 of the outer retaining element 12, which shoulder is located lower, passes, by contrast, over into a sharper corner, from which the edge 7 then drops again toward the front side 11.

The retaining elements 12, 13, 14 are directed against the direction of plugging-in 9 and form a clamping digging means at the side walls of the hollow section and at the tracks 21, 22, 23 or so-called clamping paths.

The distances 16, 17 are of equal size in the embodiment shown. However, they may also be different.

The change in the vertical offset is preferably continuous, and the heights h12 through h14 increase or decrease continuously. However, the order and association of the retaining elements 12, 13, 14 of different heights shown may also vary as desired or may be, in particular, reversed or transposed. The arrangement of the retaining elements 12, 13, 14 at the other three side walls or side wall sections 6 is designed correspondingly.

In the embodiment shown, all the retaining elements 12, 13, 14 project laterally by an equal amount within the framework of the tolerance possibilities. This lateral projection may also differ in a modified embodiment. Different possibilities of deformation or bending of the hollow section side walls can be taken into account with the different amounts of projection. For example, the higher retaining elements 14 are located farther out in FIGS. 8 and 11 than the lower retaining elements 13, 12. However, the arrangement may also be reversed, as in FIG. 6. Otherwise, different lateral amounts of projection can also be used for different purposes and requirements and may have a correspondingly different design.

In another variant of the embodiment shown, the plug-in connectors 1, especially the straight connectors according to FIGS. 1, 5 and 8 through 14, may have additional retaining elements in the form of punched-out and bent-out spring bosses. This applies especially to a reversed arrangement of the plug-in connector 1 in the hollow sections 24, when the middle wall 6 also points toward the outer side. Such a plug-in connector may have, e.g., a design corresponding to EP-A 0 698 172 and have a narrow bottom plate at the middle 10 or connection point of the hollow sections 24. Otherwise, triangular recesses or recesses of another shape may also be present at the middle wall 5 for positive-locking connection with caulking at the outer wall of the hollow section.

In addition, the middle wall 5 may also have longitudinally extending deformations 26 for covering and possibly guiding at perforation lines 25 of the hollow sections 24, which perforations lines are located on the inner side.

Furthermore, the middle wall 5 may have axial and preferably oval edge openings 29 for a bar connection 30 on both sides of the middle 10 according to FIGS. 6, 7, 8 and 11. Fastening nails 32 can be shot here through the hollow sections 24 and the plug-in connector 1 into a connection plug in the front end of a bar section 31. Otherwise, fixing or centering holes 28 may also be present at the middle wall 5 in the area of the front ends 11.

In a variant of the embodiment shown, the plug-in connector 1 may also be designed as an at least extensively solid diecast part made of light metal or as a plastic part, especially as an injection molding. The retaining elements 12, 13, 14 may also be designed as laterally projecting ribs, as wedges or in another suitable manner. The retaining elements 12, 13, 14 may be extensively rigid or also elastic at least within certain limits. They may also be arranged in any other desired area of the side walls 6 and especially also in the area of the transition point to the middle wall 5. Besides the mutual distances 16, 17, the retaining elements 12, 13, 14 may also have different sizes, especially lengths or widths. In the preferred embodiment shown, the retaining bosses 15 have extensively the same shape.

While specific embodiments of the invention have been shown and described in detail to illustrate the application of the principles of the invention, it will be understood that the invention may be embodied otherwise without departing from such principles.

What is claimed is:

1. A plug-in connector for hollow sections for spacer frames or bar sections of insulating glass panes, the plug-in connector comprising:

a middle wall and two side walls joining said middle wall, said side walls each having a plurality of lateral retaining elements arranged one after the other in a direction of plugging-into said hollow sections, at least one of said retaining elements being arranged at said side walls offset from at least another of said retaining elements with a direction of said offset being at right angles to said direction of plugging-in.

2. A plug-in connector in accordance with claim 1, wherein said retaining elements at said side walls assume different height positions relative to said middle wall.

3. A plug-in connector in accordance with claim 1, wherein said retaining elements arranged offset are adapted to act at different points on a hollow section.

4. A plug-in connector in accordance with claim 1, wherein said plug-in connector has a body with a plurality of sections that are flush in a direction of plugging-in or are bent, wherein said retaining elements located at said side walls of said sections are arranged offset in relation to one another by a distance.

5. A plug-in connector in accordance with claim 1, wherein all of said retaining elements of said side wall of a section are arranged offset by a distance from one another.

6. A plug-in connector in accordance with claim 1, wherein said plug-in connector has three or more said retaining elements arranged offset at said two side walls.

7. A plug-in connector in accordance with claim 1, wherein said retaining elements are designed as retaining bosses that are bent out laterally and act in a direction opposite to a direction of plugging-in.

8. A plug-in connector in accordance with claim 1, wherein said retaining elements are arranged at an edge area of said side wall, said edge area being adapted to be directed toward an outer side of said hollow sections.

9. A plug-in connector in accordance with claim 1, wherein said plug-in connector is designed as a punched and bent part from metal with an essentially U-shaped cross section, wherein said offset retaining bosses have cut-outs of different depths and edge-side shoulders.

10. A plug-in connector in accordance with claim 1, wherein said retaining elements project laterally by different amounts beyond said side wall.

11. A plug-in connector in accordance with claim 1, wherein said plug-in connector is designed as a straight connector and has an elastic or fixed middle stop.

12. A plug-in connector in accordance with claim 1, wherein said said middle wall has wall openings for a bar connection at both sides of a connection point.

13. A plug-in connector in accordance with claim 1, wherein said middle wall has fixing holes on both sides of a connection point.

14. A plug-in connector and hollow section combination for insulating glass panes, the combination comprising:

a hollow section; and a plug-in connector with a middle wall and two side walls joining said middle wall, said side walls each having a plurality of lateral retaining elements arranged one after the other in a direction of plugging-in to said hollow section, at least one of said retaining elements being arranged at said side walls offset from at least another of said retaining elements with a direction of said offset being substantially at right angles to said direction of plugging-in with.

15. A plug-in connector in accordance with claim 14, wherein said retaining elements at said side walls assume different height positions.

16. A plug-in connector in accordance with claim 14, wherein said retaining elements arranged offset act at different points on said hollow section.

17. A plug-in connector in accordance with claim 14, wherein said plug-in connector has a body with a plurality of sections that are flush in a direction of plugging-in or are bent, wherein said retaining elements located at said side walls of said sections are arranged offset in relation to one another by a distance.

18. A plug-in connector in accordance with claim 14, wherein all of said retaining elements of said side wall of a section are arranged offset by a distance from one another.

19. A plug-in connector in accordance with claim 14, wherein said hollow section has two side walls and said plug-in connector has three or more retaining elements arranged offset at said two side walls.

20. A plug-in connector in accordance with claim 14, wherein said retaining elements are designed as retaining bosses that are bent out laterally and act in a direction opposite to a direction of plugging-in to said hollow section.

21. A plug-in connector for hollow sections for spacer frames or bar sections of insulating glass panes, the plug-in connector comprising:

a base wall;

a side wall joining said base wall, said base wall and side wall combining to define a dimensionally stable base surface and a dimensionally stable side wall edge;

a plurality of lateral retaining elements formed as part of said side wall including a forward retaining element arranged forward with respect to a direction of plugging-into the hollow section and a trailing retaining element arranged following said forward retaining element with respect to a direction of plugging-into said hollow section, one of said forward retaining element and said trailing retaining element being arranged closer to said side wall edge and farther from said base surface, with respect to a direction perpendicular to said direction of plugging-into said hollow section, than the other of said forward retaining element and said trailing retaining element.

* * * * *